US005167671A

United States Patent [19]

Baillargeon et al.

[11] Patent Number: 5,167,671

[45] Date of Patent: * Dec. 1, 1992

[54] MULTIFUNCTIONAL ADDITIVES TO IMPROVE THE LOW-TEMPERATURE PROPERTIES OF DISTILLATE FUELS AND COMPOSITIONS CONTAINING SAME

[75] Inventors: David J. Baillargeon, Cherry Hill; Angeline B. Cardis, Florence; Dale B. Heck, West Deptford, all of N.J.

[73] Assignee: Mobil Oil Corporation, Fairfax, Va.

[ * ] Notice: The portion of the term of this patent subsequent to Mar. 26, 2008 has been disclaimed.

[21] Appl. No.: 620,674

[22] Filed: Dec. 3, 1990

[51] Int. Cl.[5] ..... C10L 1/22

[52] U.S. Cl. ..... 44/425; 44/405; 560/88; 560/89

[58] Field of Search ..... 44/425, 405; 560/88, 560/89

[56] References Cited

U.S. PATENT DOCUMENTS

| | | | |
|---|---|---|---|
| 3,502,712 | 3/1970 | De Brunner et al. | 560/88 |
| 3,530,074 | 9/1970 | De Brunner et al. | 560/88 |
| 5,002,589 | 3/1991 | Baillargeon et al. . | |
| 5,039,306 | 8/1991 | Baillargeon et al. . | |
| 5,039,309 | 8/1991 | Baillargeon et al. . | |

FOREIGN PATENT DOCUMENTS

| | | | |
|---|---|---|---|
| 0149942 | 12/1978 | Japan | 560/88 |

*Primary Examiner*—Olik Chaudhuri
*Assistant Examiner*—M. Nuzzolillo
*Attorney, Agent, or Firm*—Alexander J. McKillop; Charles J. Speciale; Howard M. Flournoy

[57] ABSTRACT

The low-temperature properties of distillate fuels are improved when reaction products of pyromellitic dianhydride and amonoalcohols and/or amines with long chain hydrocarbyl groups are incorporated therein.

45 Claims, No Drawings

MULTIFUNCTIONAL ADDITIVES TO IMPROVE THE LOW-TEMPERATURE PROPERTIES OF DISTILLATE FUELS AND COMPOSITIONS CONTAINING SAME

BACKGROUND OF THE INVENTION

This application is directed to novel pyromellitate ester and ester/amide additive reaction products which are useful for improving the low-temperature properties of distillate fuels, and fuel compositions containing same.

Traditionally, the low-temperature properties of distillate fuels have been improved by the addition of kerosene, sometimes in very large amounts (5–70 wt %). The kerosene dilutes the wax in the fuel, i.e. lowers the overall weight fraction of wax, and thereby lowers the cloud point, filterability temperature, and pour point simultaneously. The additives of this invention effectively lower both the cloud point and CFPP (Cold Filter Plugging Point) of distillate fuel without any appreciable dilution of the wax component of the fuel.

Other additives known in the art have been used in lieu of kerosene to improve the low-temperature properties of distillate fuels. Many such additives are polyolefin materials with pendent fatty hydrocarbon groups. These additives are limited in their range of activity, however; most improve fuel properties by lowering the pour point and/or filterability temperature. These same additives have little or no effect on the cloud point of the fuel. The additives of this invention effectively lower distillate fuel cloud point, and thus provide improved low-temperature fuel properties, and offer a unique and useful advantage over known distillate fuel additives. No art is known to applicants which teaches or suggests the additive products and compositions of this invention.

SUMMARY OF THE INVENTION

The novel esters and ester/amides prepared in accordance with this invention have been found to be surprisingly active wax crystal modifier additives for distillate fuels. Distillate fuel compositions containing <0.1 wt % of such additives demonstrate significantly improved low-temperature flow properties, i.e. lower cloud point and lower CFPP filterability temperature.

Thus an object of this invention is to improve the low-temperature flow properties of distillate fuels. These new additives are especially effective in lowering the cloud point of distillate fuels, and thus improve the low-temperature flow properties of such fuels without the use of any light hydrocarbon diluent, such as kerosene. In addition, the filterability properties are improved as demonstrated by lower CFPP temperatures. Thus, the additives of this invention demonstrate multifunctional activity in distillate fuels. These additives are ester or ester/amide products which have core-pendant group (star-like) structures derived from the reaction of pyromellitic dianhydride (PMDA) or its acid equivalent and suitable pendant groups derived from alcohols and amines with some combination of linear hydrocaryl groups attached. The pendant groups include (1) an aminoalcohol, the product of a secondary fatty amine capped with one or more olefin epoxides, (2) a combination of an aminoalcohol (above 1) with an amine and (3) combinations of two or more different aminoalcohols.

The compositions of these additives are unique. Also, the additive concentrates and fuel compositions containing such additives are unique. Similarly, the processes for making these additives, additive concentrates, and fuel compositions are unique.

DESCRIPTION OF PREFERRED EMBODIMENTS

The additives are reaction products obtained by combining core structure and the pendant group(s) in differing ratios using standard techniques for esterification-/amidification.

The additives of this invention have core-pendant group (star-like) structures derived from pyromellitic dianhydride (PMDA) or acid equivalents. For example, a general structure for the PMDA/aminoalcohol ester is as follows:

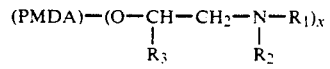

A general structure for the PMDA/aminoalcohol/amine ester/amide is as follows:

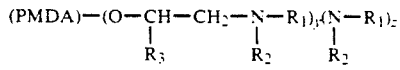

A general structure for the PMDA/mixed aminoalcohol ester is as follows:

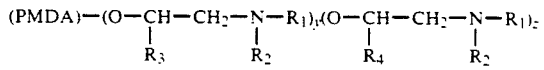

A general structure for the PMDA/aminoetheralcohol ester is as follows:

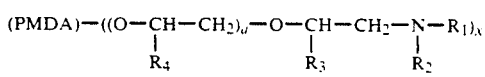

A general structure for the PMDA/aminoetheralcohol-/amine ester/amide is as follows:

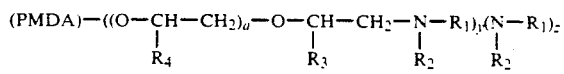

Where:

$x = y + z = 0.5–4$ $a = 1–3$ $R_1$, $R_3 = C_8$-$C_{50}$ linear hydrocarbyl groups, either saturated or unsaturated.

$R_2 = R_1$, $C_1$–$C_{100}$ hydrocarbyl $R_4 = H$, $C_1$–$C_{50}$ hydrocarbyl

Any suitable olefin oxide my be used. Epoxides are especially preferred. Included are such oxides as ethylene oxide, 1,2-epoxybutane, 1,2-epoxydecane, 1,2-epoxydodecane, 1,2-epoxytetradecane,1,2-epoxypentadecane, 1,2-epoxyhexadecane, 1,2-epoxyheptadecane, 1,2-epoxyoctadecane,1,2-epoxyeicosane and the like and mixtures thereof and mixtures of $C_{20}$ to $C_{24}$ alpha olefin epoxides, mixtures of $C_{24}$ to $C_{28}$ alpha olefin epoxides and the like.

Suitable amines, as indicated above, are secondary amines with at least one long-chain hydrocarbyl group, e.g. $C_8$ to about $C_{50}$. Highly useful secondary amines include but are not limited to di(hydrogenated tallow) amine, ditallow amine, dioctadecylamine, methyloctadecylamine and the like. In this invention, stoichiometries of amine to epoxide were chosen such that one amine reacted with each available epoxide functional group. Other stoichiometries where the amine is used in lower molar proportions may also be used.

The reactions can be carried out under widely varying conditions which are not believed to be critical. The reaction temperatures can vary from about 100° to 225° C., preferably 120° to 180° C., under ambient or autogenous pressure. However slightly higher pressures may be used if desired. The temperatures chosen will depend upon for the most part on the particular reactants and on whether or not a solvent is used. Solvents used will typically be hydrocarbon solvents such as xylene, but any non-polar, unreactive solvent can be used including benzene and toluene and/or mixtures thereof.

Molar ratios, less than molar ratios or more than molar ratios of the reactants can be used. Preferentially a molar ratio of 1:1 to about 8:1 of epoxide to amine is chosen.

The times for the reactions are also not believed to be critical. The process is generally carried out in from about one to twenty-four hours or more.

In general, the reaction products of the present invention may be employed in any amount effective for imparting the desired degree of activity to improve the low temperature characteristics of distillate fuels. In many applications the products are effectively employed in amounts from about 0.001% to about 10% by weight and preferably from less than 0.01% to about 5% of the total weight of the composition.

These additives may be used in conjunction with other known low-temperature fuel additives (dispersants, etc.) being used for their intended purpose.

The fuels contemplated are liquid hydrocarbon combustion fuels, including the distillate fuels and fuel oils. Accordingly, the fuel oils that may be improved in accordance with the present invention are hydrocarbon fractions having an initial boiling point of at least about 250° F. and an end-boiling point no higher than about 750° F. and boiling substantially continuously throughout their distillation range. Such fuel oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate fuel oils, or mixtures of straight run distillate fuel oils, naphthas and the like, with cracked distillate stocks. Moreover, such fuel oils can be treated in accordance with well-known commercial methods, such as, acid or caustic treatment, hydrogenation, solvent refining, clay treatment, etc.

The distillate fuel oils are characterized by their relatively low viscosities, pour points, and the like. The principal property which characterizes the contemplated hydrocarbons, however, is the distillation range. As mentioned hereinbefore, this range will lie between about 250° F. and about 750° F. Obviously, the distillation range of each individual fuel oil will cover a narrower boiling range falling, nevertheless, within the above-specified limits. Likewise, each fuel oil will boil substantially continuously throughout its distillation range.

Contemplated among the fuel oils are Nos. 1, 2 and 3 fuel oils used in heating and as diesel fuel oils, and the jet combustion fuels. The domestic fuel oils generally conform to the specification set forth in A.S.T.M. Specifications D396-48T. Specifications for diesel fuels are defined in A.S.T.M. Specification D975-48T, Typical jet fuels are defined in Military Specification MIL-F-5624B.

The following examples are illustrative only and are not intended to limit the scope of the invention.

EXAMPLE 1

Preparation of Additive 1

Di(hydrogenated tallow) amine (59.8 g, 0.12 mol; e.g. Armeen 2HT from Akzo Chemie), and 1,2-epoxyoctadecane (32.2 g, 0.12 mol; e.g. Vikolox 18 from Viking Chemical) were combined and heated at 160° C. for 16 hours. Pyromellitic dianhydride (6.54 g, 0.03 mol; e.g. PMDA from Allco Chemical Corp.), and xylene (approx. 30 ml) were added and heated at reflux (160°-200° C.) with azeotropic removal of water for 24 hours. Volatiles were then removed from the reaction medium at 190°-200° C., and the reaction mixture was hot filtered to give 94.6 g of the final product as a low melting solid.

EXAMPLE 2

Preparation of Additive 2

According to the procedure used for Example 1 (above), di(hydrogenated tallow) amine (45.0 g, 0.09 mol), and 1,2-epoxyoctadecane (30.2 g, 0.112 mol) were first combined. Pyromellitic dianhydride (9.82 g, 0.045 mol) was then added, and allowed to react in the second step of the sequence. The final product (72.6 g) was obtained as a low-melting solid.

EXAMPLE 3

Preparation of Additive 3

According to the procedure used for Example 1 (above), di(hydrogenated tallow) amine (74.9 g, 0.15 mol), and 1,2-epoxyoctadecane (20.1 g, 0.075 mol) were first combined. Pyromellitic dianhydride (8.18 g, 0.0375 mol) was then added, and allowed to react in the second step of the sequence. The final product (99.4 g) was obtained as a low-melting solid.

EXAMPLE 4

Preparation of Additive 4

According to the procedure used for Example 1 (above), di(hydrogenated tallow) amine (74.9 g, 0.15 mol), and 1,2-epoxyoctadecane (20.1 g, 0.075 mol) were first combined. Pyromellitic dianhydride (8.18 g, 0.0375 mol) was then added, and allowed to react in the second step of the sequence. The final product (99.4 g) was obtained as a low-melting solid.

EXAMPLE 5

Preparation of Additive 5

According to the procedure used for Example 1 (above), di(hydrogenated tallow) amine (62.4 g, 0.125 mol), and 1,2-epoxyoctadecane (21.0 g, 0.0781 mol) were first combined. Pyromellitic dianhydride (13.6 g, 0.0625 mol) was then added, and allowed to react in the second step of the sequence. The final product (85.5 g) was obtained as a low-melting solid.

EXAMPLE 6

Preparation of Additive 6

According to the procedure used for Example 1 (above), ditallow amine (49.8 g, 0.10 mol); e.g. Armeen 2T from Akzo Chemie), and 1,2-epoxyoctadecane (28.2 g, 0.105 mol; e.g. Vikolox 18 from Viking Chemical) were first combined. Pyromellitic dianhydride (5.45 g, 0.025 mol) was then added, and allowed to react in the second step of the sequence. The final product (84.1 g) was obtained as a low-melting solid.

EXAMPLE 7

Preparation of Additive 7

According to the procedure used for Example 1 (above), ditallow amine (49.8 g, 0.10 mol), and 1,2-epoxyoctadecane (33.6 g, 0.125 mol) were first combined. Pyromellitic dianhydride (7.27 g, 0.033 mol) was then added, and allowed to react in the second step of the sequence. The final product (81.4 g) was obtained as a low-melting solid.

EXAMPLE 8

Preparation of Additive 8

According to the procedure used for Example 1 (above), ditallow amine (49.8 g, 0.10 mol), and 1,2-epoxyoctadecane (33.6 g, 0.125 mol) were first combined. Pyromellitic dianhydride (10.9 g, 0.050 mol) was then added, and allowed to react in the second step of the sequence. The final product (83.3 g) was obtained as a party solidified solid.

EXAMPLE 9

Preparation of Additive 9

According to the procedure used for Example 1 (above), di(hydrogenated tallow) amine (40.0 g, 0.080 mol), and 1,2-epoxyeicosane (28.7 g, 0.088 mol; e.g. Vikolox 20 from Viking Chemical) were combined at 220° C. Pyromellitic dianhydride (9.60 g, 0.044 mol) was then added, and allowed to react in the second step of the sequence. The final product (69.8 g) was obtained as a low-melting solid.

EXAMPLE 10

Preparation of Additive 10

According to the procedure used for Example 1 (above), di(hydrogenated tallow) amine (40.0 g, 0.080 mol), and a mixture of $C_{20}$–$C_{24}$ alpha olefin epoxides (30.4 g, 0.088 mol; e.g. Vikolox 20–24 from Viking Chemical) were combined at 220° C. Pyromellitic dianhydride (9.60 g, 0.044 mol) was then added, and allowed to react in the second step of the sequence. The final product (70.9 g) was obtained as a low-melting solid.

EXAMPLE 11

Preparation of Additive 11

According to the procedure used for Example 1 (above), di(hydrogenated tallow) amine (35.0 g, 0.070 mol), and a mixture of $C_{24}$–$C_{28}$ alpha olefin epoxides (33.7 g, 0.077 mol; e.g. Vikolox 24–28 from Viking Chemical) were combined at 220° C. Pyromellitic dianhydride (8.40 g, 0.0385 mol) was then added, and allowed to react in the second step of the sequence. The final product (69.0 g) was obtained as a low-melting solid.

EXAMPLE 12

Preparation of Additive 12

Di(hydrogenated tallow) amine (50.0 g, 0.10 mol), and 1,2-epoxyoctadecane (33.6 g, 0.125 mol) were combined and heated at 150° C. for 16 hours. To the cooled reaction mixture was added potassium t-butoxide (0.56 g, 0.005 mol), and 1,2-epoxybutane (13.5 g, 0.187 mol). The mixture was 105°–115° C. for 20 hours, to 150° C. for 1 hour, followed by removal of all volatiles at 150° C. Pyromellitic dianhydride (6.00 g, 0.0275 mol), and xylene (approx. 50 ml) were added and heated at reflux (180°–190° C.) with azeotropic removal of water for 6 hours. Volatiles were then removed from the reaction medium at 180°–190° C., and the reaction mixture was hot filtered to give 83.5 g of the final product as a low-melting solid.

EXAMPLE 13

Preparation of Additive 13

Di(hydrogenated tallow) amine (30.0 g, 0.060 mol), and 1,2-epoxyoctadecane (16.1 g, 0.060 mol) were combined and heated at 150° C. for 24 hours. To the cooled reaction mixture was added potassium t-butoxide (0.17 g, 0.0015 mol), and 1,2-epoxybutane (5.41 g, 0.075 mol). The mixture was heated to 105°–115° C. for 20 hours, followed by removal of all volatiles at 150° C. Pyromellitic dianhydride (7.20 g, 0.033 mol), di(hydrogenated tallow) amine (30.0 g, 0.060 mol), and xylene (approx. 50 ml) were added and heated at reflux (180°–190° C.) with azeotropic removal of water for 24 hours. Volatiles were then removed from the reaction medium at 180°–190° C., and the reaction mixture was hot filtered to give 76.2 g of the final product as a low-melting solid.

EXAMPLE 14

Preparation of Additive 14

Di(hydrogenated tallow) amine (60.0 g, 0.12 mol), and 1,2-epoxyoctadecane (20.1 g, 0.075 mol) were combined and heated at 150° C. for 24 hours. The reaction mixture (above) and 1,2-epoxybutane (13.0 g, 0.180 mol), was heated in a sealed glass pressure bottle at 170°–190° C. for 7 hours, under autogenous pressure. Volatiles were removed at 150° C./atm. pressure. To this was added pyromellitic dianhydride (7.20 g, 0.033 mol), and xylene (approx. 50 ml) followed by heating at reflux (180°–190° C.) with azeotropic removal of water for 24 hours. Volatiles were then removed from the reaction medium at 180°–190° C., and the reaction mixture was hot filtered to give 78.4 g of the final product as a low-melting solid.

Preparation of Additive Concentrate

A concentrate solution of 100 ml total volume was prepared by dissolving 10 g of additive in mixed xylenes solvent. Any insoluble particulates in the additive concentrate were removed by filtration before use. Generally speaking however, each 100 ml of concentrate solution may contain from about 1 to about 50 grams of the additive product of reaction.

| Test Fuel Characteristics | |
|---|---|
| FUEL A: | |
| API Gravity | 35.5 |
| Cloud Point (°F.) | |
| Auto CP | 15 |

-continued

| Test Fuel Characteristics | |
|---|---|
| Herzog | 16.4 |
| Pour Point (°F.) | 10 |
| CFPP. (°F.) | 9 |
| FUEL B: | |
| API Gravity | 34.1 |
| Cloud Point (°F.) | |
| Auto CP | 22 |
| Herzog | 23.4 |
| CFPP. (°F.) | 16 |
| Pour Point (°F.) | 0 |

Test Procedures

The cloud point of the additized distillate fuel was determined using two procedures: (a) an automatic cloud point test based on the commercially available Herzog cloud point tester; test cooling rate is approximately 1° C./min. Results of this test protocol correlate well with ASTM D2500 methods. The test designation (below) is "HERZOG." (b)an automatic cloud point test based on the equipment procedure detailed in U.S. Pat. No. 4,601,303; the test designation (below) is AUTO CP.

The low-temperature filterability was determined using the Cold Filter Plugging Point (CFPP) test. This test procedure is described in "Journal of the Institute of Petroleum," Volume 52, Number 510, June 1966, pp. 173–185.

Test results may be found in the Table below.

TABLE

ADDITIVE EFFECTS ON THE CLOUD POINT AND FILTERABILITY (CPFF) OF DISTILLATE FUEL (ADDITIVE CONCENTRATION = 0.1 WT %)

| | Improvement in Performance Temperature (°F.) | | | | | |
|---|---|---|---|---|---|---|
| | Diesel Fuel A Cloud Point | | | Diesel Fuel B Cloud Point | | |
| Additive | (Auto CP) | (Herzog) | CFPP | (Auto CP) | (Herzog) | CFPP |
| 1 | 2 | 0.7 | 7 | 8.5 | 7.2 | 7 |
| 2 | 3 | 2.5 | 7 | 8.5 | 7.8 | 2 |
| 3 | 3 | 1.8 | 7 | 9.5 | 7.9 | 9 |
| 4 | 3 | 2.9 | 6 | 8 | 7.6 | 6 |
| 5 | 4 | 3.8 | 4 | 7 | 7 | 6 |
| 6 | 3 | 1.5 | 7 | 9.5 | 7.4 | 7 |
| 7 | 3 | 2.2 | 4 | 8.5 | 7.4 | 4 |
| 8 | 3 | 2.4 | 2 | 8.5 | 7.2 | 2 |
| 9 | 3 | 1.8 | 6 | 9 | — | 15 |
| 10 | 2 | 1.4 | 6 | 8 | 9.9 | 13 |
| 11 | 1 | — | 4 | 7 | — | 11 |
| 12 | 1 | 1.1 | 4 | 8.5 | 7.2 | 7 |
| 13 | 2 | 1.3 | 0 | 7.5 | 6.9 | 2 |
| 14 | — | 1.8 | 8 | — | 7.2 | 11 |

The above test results clearly demonstrate the improved low temperature characteristics of distillate fuels to which the additives in accordance with the invention have been added.

We claim:

1. A product of the reaction of pyromellitic dianhydride or its acid equivalent and (1) an aminoalcohol or mixture of aminoalcohols or (2) a combination of an aminoalcohol or mixture of aminoalcohols and a secondary amine said reactants being reacted in substantially molar, less than molar or more than molar amounts at temperatures varying from about 85 to about 250° C. under pressures varying from about ambient or autogenous to slightly higher for a time sufficient to obtain the desired ester or ester/amide additive product of reaction having a core structure derived from PMDA or its acid equivalent and pendant groups derived from said aminoalcohol and/or secondary amine having from $C_1$ to about $C_{100}$ hydrocarbyl or H groups.

2. The product of claim 1 wherein (1) the aminoalcohol is derived from an olefin epoxide and said secondary amine.

3. The product of claim 2 wherein the aminoalcohol is derived from di(hydrogenated tallow)amine and 1,2-epoxyoctadecane.

4. The product of claim 3 wherein the amine is ditallow amine.

5. The product of claim 2 wherein the epoxide is 1,2-epoxyeicosane.

6. The product of claim 2 wherein the epoxide is a mixture of $C_{20}$ to $C_{24}$ alpha olefin epoxides.

7. The product of claim 2 wherein the epoxide is a mixture of $C_{24}$ to $C_{28}$ alpha olefin epoxides.

8. The product of claim 1 wherein said reaction product is a pyromellitic dianhydride/aminoalcohol ester having the following structure:

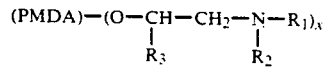

Where:

$x = 0.5–4$ $R_1$, $R_3 = C_8–C_{50}$ saturated or unsaturated linear hydrocarbyl groups.

$R_2 = R_1$, $C_1–C_{100}$ hydrocarbyl

9. The product of claim 1 wherein said reaction product is a pyromellitic dianhydride/aminoalcohol/amine ester/amide having the following structure:

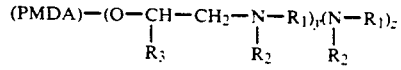

Where $x + z = 0.5–4$ $R_1$, $R_3 = C_8–C_{50}$ saturated or unsaturated linear hydrocarbyl groups.

$R_2 = R_1$, $C_1–C_{100}$ hydrocarbyl

10. The product of claim 1 wherein said reaction product is a pyromellitic dianhydride/mixed aminoalcohol ester having the following structure:

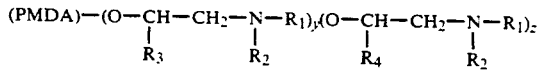

Where:

$y + z = 0.5–4$ $R_1$, $R_3 = C_8–C_{50}$ saturated or unsaturated linear hydrocarbyl groups.

$R_2 = R_1$, $C_1–C_{100}$ hydrocarbyl $R_4 = H$, $C_1–C_{50}$ hydrocarbyl

11. The product of claim 1 wherein said reaction product is a pyromellitic dianhydride/aminoetheralcohol ester having the following structure:

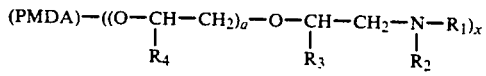

Where:

$x = 0.5–4$ a=1-3

$R_1$, $R_3$=$C_8$-$C_{50}$ saturated or unsaturated linear hydrocarbyl groups.

$R_2$=$R_1$, $C_1$-$C_{100}$ hydrocarbyl

R=H, $C_1$-$C_{50}$ hydrocarbyl

12. The product of claim 1 wherein said reaction product is a pyromellitic dianhydride/aminoetheralcohol/amine ester/amide having the following structure:

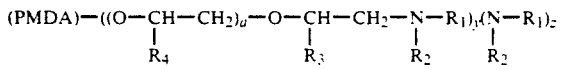

y+z=0.5-4 a=1-3

$R_1$, $R_3$=$C_{8-C50}$ saturated or unsaturated linear hydrocarbyl groups.

$R_2$=$R_1$, $C_1$-$C_{100}$ hydrocarbyl $R_4$=H, $C_1$-$C_{50}$ hydrocarbyl

13. The product of claim 2 wherein the amine is selected from the group consisting of ditallow amine, di(hydrogenated tallow) amine, dioctadecylamine, methyloctadecylamine or mixtures thereof.

14. An improved fuel composition comprising a major proportion of a liquid hydrocarbon fuel and a minor low temperature improving amount of the reaction product of a pyromellitic dianhydride or its acid equivalent equivalent and (1) an aminoalcohol or mixture of aminoalcohols or (2) a combination of an aminoalcohol or mixture of aminoalcohols and a secondary amine said reactants being reacted in substantially molar, less than molar or more than molar amounts at temperatures varying from about 85° to about 250° C. under pressures varying from about ambient or autogenous to slightly higher for a time sufficient to obtain the desired ester or ester/amide additive product of reaction having a core structure derived from PMDA or its acid equivalent and pendant groups derived from said aminoalcohol and/or secondary amine having from $C_1$ to about $C_{100}$ hydrocarbyl or H groups.

15. The fuel composition of claim 14 comprising from about 0.001% to about 10% by weight of the total composition of said additive reaction product.

16. The fuel composition of claim 14 wherein the aminoalcohol is derived from an olefin epoxide and a secondary amine.

17. The fuel composition of claim 14 wherein the aminoalcohol is derived from di(hydrogenated tallow-)amine and 1,2-epoxyoctadecane.

18. The fuel composition of claim 14 wherein the amine is ditallow amine.

19. The fuel composition of claim 14 wherein the epoxide is 1,2-epoxyeicosane.

20. The fuel composition of claim 14 wherein the epoxide is a mixture of $C_{20}$ to $C_{24}$ alpha olefin epoxides.

21. The fuel composition of claim 14 wherein the epoxide is a mixture of $C_{24}$ to $C_{28}$ alpha olefin epoxides.

22. The fuel composition of claim 14 wherein said reaction product is a pyromellitic dianhydride/aminoalcohol ester having the following structure:

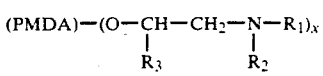

Where:

x =0.5-4

$R_1$, $R_3$=$C_8$-$C_{50}$ linear hydrocarbyl groups. either saturated or unsaturated.

$R_2$=$R_1$, $C_1$-$C_{100}$ hydrocarbyl

23. The fuel composition of claim 14 wherein said reaction product is a pyromellitic dianhydride/aminoalcohol/amine ester/amide having the following structure:

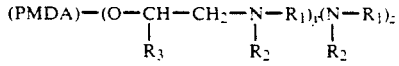

Where:

x=0.5-4 a=1-3

$R_1$, $R_3$=$C_8$-$C_{50}$ saturated or unsaturated linear hydrocarbyl groups.

$R_2$=$R_1$, $C_1$-C hydrocarbyl

24. The fuel composition of claim 14 wherein said reaction product is a pyromellitic dianhydride/mixed aminoalcohol ester having the following structure:

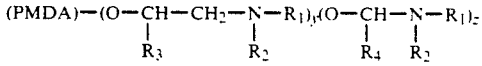

Where:

y+z=0.5-4

$R_1$, $R_3$=$C_8$-$C_{50}$ saturated or unsaturated linear hydrocarbyl groups.

$R_2$=$R_1$, $C_1$-$C_{100}$ hydrocarbyl $R_4$=H, $C_1$-$C_{50}$ hydrocarbyl

25. The fuel composition of claim 14 wherein said reaction product is a pyromellitic dianhydride/aminoetheralcohol ester having the following structure:

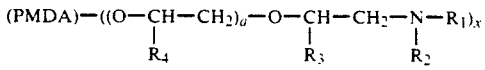

Where:

+z=0.5-4 a=1-3

$R_1$, $R_3$=$C_8$-$C_{50}$ saturated or unsaturated linear hydrocarbyl groups.

$R_2$=$R_1$, $C_1$-$C_{100}$ hydrocarbyl $R_4$=H, $C_1$-C hydrocarbyl

26. The fuel composition of claim 14 wherein said reaction product a pyromellitic dianhydride/aminoetheralcohol/amine ester/amide having the following structure:

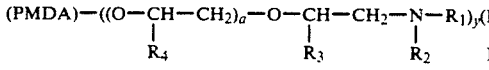

Where:

y+z=0.5-4 a=1-3

$R_1$, $R_3$=$C_8$-$C_{50}$ saturated or unsaturated linear hydrocarbyl groups.

$R_2$=$R_1$, $C_1$-$C_{100}$ hydrocarbyl $R_4$=H, $C_1$-$C_{50}$ hydrocarbyl

27. The composition of claim 14 wherein the fuel is a liquid hydrocarbon combustion fuel selected from the group consisting of distillate fuels and fuel oils.

28. The composition of claim 27 wherein the fuel oil is selected from fuel oil numbers 1, 2 and 3 and diesel fuel oils and jet combustion fuels.

29. The composition of claim 28 wherein the fuel is a diesel fuel.

30. An additive concentrate solution comprising at least one inert liquid hydrocarbon solvent or mixture of solvents having dissolved therein an additive product of reaction produced by the reaction of pyromellitic dianhydride or acid equivalent and (1) an aminoalcohol or combination or mixture of aminoalcohols or (2) an aminoalcohol or combination or mixture of aminoalcohols and a secondary amine said reactants being reacted in substantially molar, less than molar or more than molar amounts at temperatures varying from about 85° to about 250° C. under pressures varying from about ambient or autogenous to slightly higher for a time sufficient to obtain the desired poly(aminoalcohol) additive product of reaction.

31. The additive concentrate solution of claim 30 comprising wherein each 100 ml portion contains dissolved from about 1 to about 50 grams of said additive product of reaction.

32. The additive concentrate solution of claim 31 wherein each 100 ml portion contains dissolved therein 10 grams of said additive product of reaction.

33. The additive concentrate of claim 30 wherein said solvent is mixed xylenes solvent.

34. A process for preparing an additive product of reaction suitable for use in liquid fuel compositions comprising reacting in substantially molar ratios, less than molar ratios or more than molar ratios a pyromellitic dianhydride or acid equivalent and (1) an aminoalcohol or combination or mixture of aminoalcohols or (2) a combination of an aminoalcohol or mixture of aminoalcohols and a secondary amine under reaction conditions varying from temperatures of 85° to 250° C., pressures from ambient to slightly higher for a time sufficient to obtain the desired product having a core structure derived from PMDA or its acid equivalent and pendant groups derived from said aminoalcohol and/or secondary amine having from $C_1$ to about $C_{100}$ hydrocarbyl or H groups.

35. The process of claim 34 wherein the aminoalcohol is derived from an olefin epoxide and a secondary amine.

36. The process of claim 35 wherein the aminoalcohol is derived from di(hydrogenated tallow)amine and 1,2-epoxyoctadecane.

37. The process of claim 35 wherein the amine is ditallow amine.

38. The process of claim 35 wherein the epoxide is 1,2-epoxyeicosane.

39. The process of claim 35 wherein the epoxide is a mixture of $C_{20}$ to $C_{24}$ alpha olefin epoxides.

40. The process of claim 35 wherein the epoxide is a mixture of $C_{24}$ to $C_{28}$ alpha olefin epoxides.

41. The process of claim 34 wherein said reaction product is a pyromellitic dianhydride/aminoalcohol ester having the following structure:

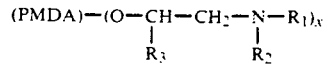

Where:

$x=0.5-4$ $R_1$, $R_3=C_8-C_{50}$ linear hydrocarbyl groups, either saturated or unsaturated.

$R_2=R_1$, $C_1-C_{100}$ hydrocarbyl

42. The process of claim 34 wherein said reaction product is a pyromellitic dianhydride/aminoalcohol/ester/amide having the following structure:

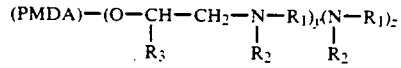

Where:

$x=0.5-4$ $R_1$, $R_3=C_8-C_{50}$ linear hydrocarbyl groups, either saturated or unsaturated.

$R_2=R_1$, $C_1-C_{100}$ hydrocarbyl

43. The process of claim 34 wherein said reaction product is a pyromellitic dianhydride/mixed aminoalcohol ester having the following structure:

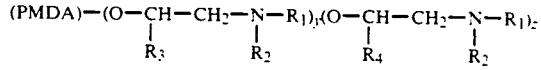

Where:

$y+z=0.5-4$ $R_1$, $R_3=C_8-C_{50}$ linear hydrocarbyl groups, either saturated or unsaturated.

$R_2=R_1$, $C_1-C_{100}$ hydrocarbyl

44. The process of claim 34 wherein said reaction product is a pyromellitic dianhydride/aminoetheralcohol ester having the following structure:

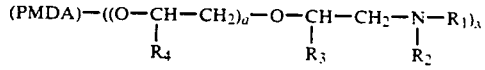

Where:

$x=0.5-4$ $a=1-3$ $R_1$, $R_3=C_8-C_{50}$ saturated or unsaturated linear hydrocarbyl groups.

$R_2=R_1$, $C_1-C_{100}$ hydrocarbyl $R=H$, $C_1-C$ hydrocarbyl

45. The process of claim 34 wherein said reaction product is a pyromellitic dianhydride/aminoetheralcohol/amine ester/amide having the following structure:

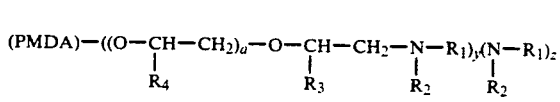

Where:

$y+z=0.5-4$ $a=1-3$ $R_3=C_8-C_{50}$ saturated or unsaturated linear hydrocarbyl groups.

$R_2=R_1$, $C_1-C_{100}$ hydrocarbyl $R_4=H$, $C_1-C_{50}$ hydrocarbyl

* * * * *

UNITED STATES PATENT AND TRADEMARK OFFICE

CERTIFICATE OF CORRECTION

PATENT NO. : 5,167,671

DATED : December 1, 1992

INVENTOR(S) : David J. Baillargeon, et al.

It is certified that error appears in the above-identified patent and that said Letters Patent is hereby corrected as shown below:

Col. 8, line 41, Claim 9: "x+z=0.5-4" should read -- y+z=0.5-4 --.

Col. 10, line 19, Claim 23: "C hydrocarbyl" should read --$C_{100}$ hydrocarbyl --.

Col. 10, line 43, Claim 25: "+z=0.5-4" should read --x=0.5-4--.

Col. 10, line 49, Claim 25, "C hydrocarbyl" should read --$C_{50}$ hydrocarbyl--.

Col. 12, line 51, Claim 44, "R=H, $C_1$-C hydrocarbyl" should read --$R_4$=H, $C_1$-$C_{50}$ hydrocarbyl--.

Col. 12, line 64, Claim 45, insert --$R_1$,-- before "$R_3$".

Signed and Sealed this

Seventh Day of December, 1993

*Attest:*

*Attesting Officer*

BRUCE LEHMAN

*Commissioner of Patents and Trademarks*